US010119351B2

(12) United States Patent
Flores et al.

(10) Patent No.: US 10,119,351 B2
(45) Date of Patent: Nov. 6, 2018

(54) PERFORATOR WITH A MECHANICAL DIVERSION TOOL AND RELATED METHODS

(71) Applicant: BAKER HUGHES INCORPORATED, Houston, TX (US)

(72) Inventors: Juan C. Flores, The Woodlands, TX (US); Luis A. Castro, Sr., Spring, TX (US); Andre J. Porter, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 370 days.

(21) Appl. No.: 14/688,487

(22) Filed: Apr. 16, 2015

(65) Prior Publication Data

US 2016/0305210 A1 Oct. 20, 2016

(51) Int. Cl.
*E21B 29/08* (2006.01)
*E21B 33/12* (2006.01)
(Continued)

(52) U.S. Cl.
CPC ..... *E21B 29/08* (2013.01); *E21B 33/124* (2013.01); *E21B 43/114* (2013.01); *E21B 43/26* (2013.01)

(58) Field of Classification Search
CPC ..... E21B 43/26; E21B 43/114; E21B 43/119; E21B 33/124; E21B 33/126; E21B 33/128
See application file for complete search history.

(56) References Cited

U.S. PATENT DOCUMENTS 2,831,429 A * 4/1958 Moore ..... F42B 3/08 102/307
3,064,731 A * 11/1962 Hall ..... E21B 33/14 166/173

(Continued)

FOREIGN PATENT DOCUMENTS

WO 0063520 A1 10/2000
WO WO 03042496 A1 * 5/2003 ..... E21B 43/25

OTHER PUBLICATIONS

Horiba, "Frac Sand & Proppant Applications", https://web.archive.org/web/20120414172341/http://www.horiba.com/scientific/products/particle-characterization/applications/frac-sand/, 7 pages (Year: 2012).*

(Continued)

*Primary Examiner* — Jennifer H Gay
(74) *Attorney, Agent, or Firm* — Mossman, Kumar & Tyler PC

(57) ABSTRACT

An apparatus can include a well treatment system that supplies a treatment fluid, a conveyance device and a well tool conveyed by the conveyance device. The well tool can include a perforator configured to form at least one hole in the wellbore tubular and a restrictor projecting from an outer surface of the well tool and adjacent to the perforator. A gap may separate the restrictor and the wellbore tubular. The well tool may also include a flow space that provides fluid communication between a location uphole of the restrictor and a location downhole of the restrictor. The flow space is sized to be restricted by particles in the treatment fluid. The restrictor at least restricts fluid flow through an annulus between the restrictor and the wellbore tubular, and the well tool diverts a substantial amount of the treatment fluid through an at least one hole formed by the perforator. It is emphasized that this abstract is provided to comply with the (Continued)

rules requiring an abstract, which will allow a searcher or other reader to quickly ascertain the general subject matter of the technical disclosure.

16 Claims, 6 Drawing Sheets

(51) Int. Cl.

| | |
|---|---|
| ***E21B 43/11*** | (2006.01) |
| ***E21B 43/26*** | (2006.01) |
| ***E21B 33/124*** | (2006.01) |
| ***E21B 43/114*** | (2006.01) |

(56) References Cited

U.S. PATENT DOCUMENTS

| | | | | | |
|---|---|---|---|---|---|
| 3,455,387 | A * | 7/1969 | Peters | E21B 43/02 | 166/191 |
| 3,645,331 | A * | 2/1972 | Maurer | E21B 7/18 | 138/42 |
| 3,797,572 | A * | 3/1974 | Mignotte | E21B 23/06 | 166/127 |
| 4,372,384 | A * | 2/1983 | Kinney | E21B 43/04 | 166/278 |
| 4,756,371 | A * | 7/1988 | Brieger | E21B 37/00 | 166/312 |
| 5,287,741 | A * | 2/1994 | Schultz | E21B 49/088 | 166/250.17 |
| 6,006,838 | A | 12/1999 | Whiteley et al. | | |
| 6,095,245 | A * | 8/2000 | Mount | E21B 43/04 | 166/114 |
| 6,439,313 | B1 * | 8/2002 | Thomeer | E21B 23/02 | 166/298 |
| 6,491,098 | B1 * | 12/2002 | Dallas | E21B 43/116 | 166/297 |
| 7,059,407 | B2 | 6/2006 | Tolman et al. | | |
| 7,673,673 | B2 * | 3/2010 | Surjaatmadja | E21B 33/13 | 166/177.4 |
| 8,511,394 | B2 * | 8/2013 | Themig | E21B 33/124 | 166/185 |
| 8,584,759 | B2 * | 11/2013 | O'Malley | E21B 33/1208 | 166/177.5 |
| 8,899,339 | B2 * | 12/2014 | Tolman | E21B 33/10 | 166/186 |
| 9,624,750 | B2 * | 4/2017 | Entchev | E21B 33/12 | |
| 2002/0092654 | A1 | 7/2002 | Coronado et al. | | |
| 2002/0104650 | A1 * | 8/2002 | Dusterhoft | E21B 34/06 | 166/227 |
| 2006/0000620 | A1 * | 1/2006 | Hamilton | E21B 43/26 | 166/387 |
| 2006/0180320 | A1 * | 8/2006 | Hilsman | E21B 33/12 | 166/387 |
| 2006/0185839 | A1 * | 8/2006 | Tiernan | E21B 43/263 | 166/63 |
| 2007/0017679 | A1 * | 1/2007 | Wolf | E21B 23/006 | 166/312 |
| 2008/0066912 | A1 * | 3/2008 | Freyer | E21B 33/1208 | 166/297 |
| 2008/0115943 | A1 * | 5/2008 | Myers | E21B 43/1195 | 166/386 |
| 2008/0271894 | A1 * | 11/2008 | Hill | E21B 23/065 | 166/308.1 |
| 2011/0036590 | A1 | 2/2011 | Williamson et al. | | |
| 2011/0284246 | A1 * | 11/2011 | Myers | E21B 43/1195 | 166/386 |
| 2012/0067582 | A1 * | 3/2012 | Fincher | E21B 43/263 | 166/308.1 |
| 2012/0097398 | A1 * | 4/2012 | Ravensbergen | E21B 34/102 | 166/308.1 |
| 2012/0160516 | A1 * | 6/2012 | Ravensbergen | E21B 23/02 | 166/380 |
| 2012/0217013 | A1 * | 8/2012 | O'Malley | E21B 17/10 | 166/308.1 |
| 2013/0180721 | A1 * | 7/2013 | Getzlaf | E21B 34/06 | 166/308.1 |
| 2013/0264054 | A1 * | 10/2013 | East | E21B 34/14 | 166/270.1 |
| 2014/0158350 | A1 | 6/2014 | Castillo et al. | | |
| 2015/0021021 | A1 * | 1/2015 | Merron | E21B 34/14 | 166/255.1 |
| 2015/0240598 | A1 * | 8/2015 | Zhou | E21B 34/14 | 166/305.1 |
| 2016/0305210 | A1 * | 10/2016 | Flores | E21B 29/08 | |

OTHER PUBLICATIONS

PCT/US2016/027766—International Search Report and Written Opinion dated Jul. 27, 2016.

* cited by examiner

PERFORATOR WITH A MECHANICAL DIVERSION TOOL AND RELATED METHODS

BACKGROUND OF THE DISCLOSURE

1. Field of the Disclosure

This disclosure relates generally to oilfield downhole tools and more particularly to methods and devices for performing multiple perforation and treatment operations using a perforator and a restrictor.

2. Description of the Related Art

Wellbore operations such as drilling, wireline logging, completions, perforations and interventions are performed to produce oil and gas from underground reservoirs. Wellbores can extend thousands of feet underground to the underground reservoirs. Many operations require multiple types of operations at a specific depth along the wellbore. Some of these operations require a section of the wellbore to be isolated. In some aspects, the present disclosure is directed to methods and devices for selectively isolating a section of a well during perforating and well treatment operations.

SUMMARY OF THE DISCLOSURE

In one aspect, the present disclosure provides a downhole tool for performing a downhole operation in a wellbore tubular. The downhole tool may include a well treatment system that supplies a treatment fluid. The downhole tool may also have a conveyance device and a well tool conveyed by the conveyance device. The well tool may include a perforator configured to form at least one hole in the wellbore tubular, and a restrictor projecting from an outer surface of the well tool. The restrictor may be adjacent to the perforator. A gap separates the restrictor and the wellbore tubular. The restrictor at least restricts fluid flow between the restrictor and the wellbore tubular. Also, the restrictor diverts a substantial amount of the treatment fluid through the at least one hole formed by the perforator.

In another aspect, the present disclosure provides a downhole tool for performing a downhole operation in a wellbore tubular. The downhole tool may include a well treatment system that supplies a treatment fluid. The downhole tool may also have a conveyance device and a well tool conveyed by the conveyance device. The well tool may include a perforator configured to form at least one hole in the wellbore tubular, and a restrictor projecting from an outer surface of the well tool. The restrictor may be adjacent to the perforator. The restrictor restricts fluid flow through an annulus between the restrictor and the wellbore tubular. The well tool may also have a flow space that provides fluid communication between a location uphole of the restrictor and a location downhole of the restrictor. The flow space is sized to allow for the formation of a flow restriction by particles in the treatment fluid. The well tool diverts a substantial amount of the treatment fluid through the at least one hole formed by the perforator.

In another aspect, the present disclosure provides a method of performing a downhole operation in a wellbore tubular. The method may include deploying a perforator and a restrictor at a target depth using a conveyance device. The restrictor is disposed at least partially in an annulus between the conveyance device and the wellbore tubular. The method may also include activating the perforator, opening an at least one hole in the wellbore tubular, and pumping a treatment fluid into the wellbore tubular. The method may also comprise restricting flow through a gap across the restrictor to divert a substantial amount of the treatment fluid into the opened hole in the wellbore tubular using the restrictor. The gap is sized to allow for the formation of a flow restriction by particles in the treatment fluid.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

The present disclosure relates to devices and methods for performing a well treatment job using a perforator and a well treatment tool. The well treatment tool includes a restrictor that can isolate a section of a wellbore tubular in which the well treatment tool is positioned. A flow space provides selective communication between the location uphole the restrictor and the downhole of the restrictor. In one embodiment, the flow space includes a gap separating the wellbore tubular and the restrictor, and is sized to allow the restrictor to travel through a bore of the wellbore tubular with relative ease. In another embodiment, the flow space can include an opening that communicates fluid across the restrictor. During operation, the flow space becomes partially or completely blocked with material(s) pumped downhole, which provides the desired isolation. Illustrative well tools including perforators and restrictors are described below.

Figure 1:
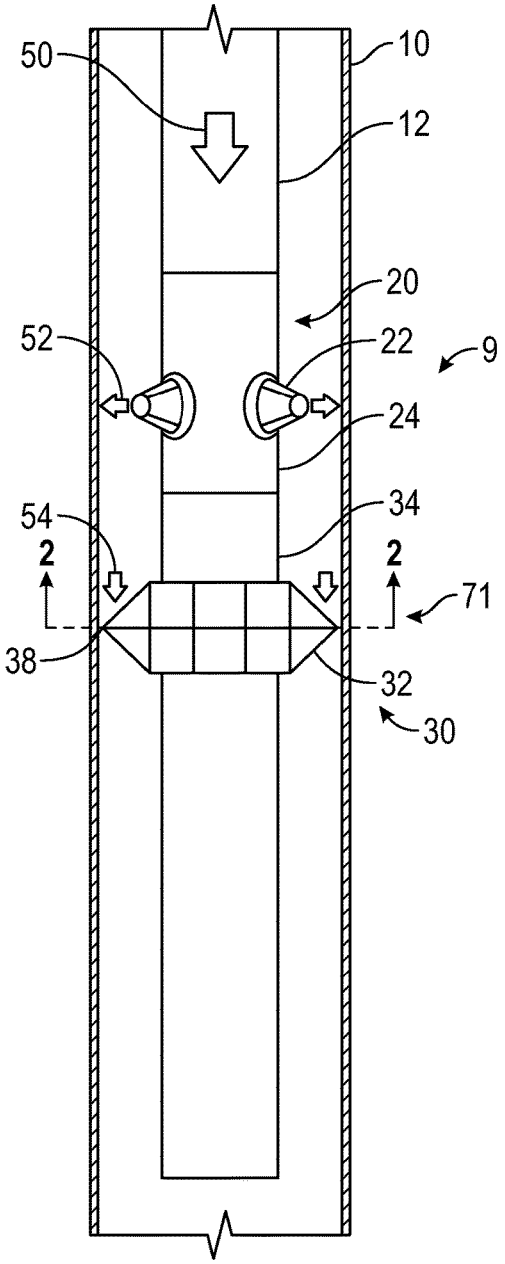
FIG. 1 shows an exemplary perforator and restrictor with a single restriction element according to the present disclosure.

FIG. 1 shows one non-limiting embodiment of the well tool 9 for perforation and well treatment operations. The well tool 9 may be run in conjunction with other bottom hole assemblies inside a wellbore tubular 10 such as a casing, liner, tubing or other suitable tubular. The well tool 9 has a perforator 20 positioned next to a restrictor 30. A conveyance device 12 is used to deploy and retrieve the well tool 9 into the wellbore tubular 10.

The perforator 20 is used to open holes 16 (not shown) in the wellbore tubular 10 before the treatment operation. The perforator 20 includes a housing 24 that has hydraulic jet nozzles 22. The conveyance device 12 provides perforating fluid to the perforator 20 through its flow bore in a downhole direction 50. The flow rate may range from 0.5 barrel per minute (bpm) up to 12 bpm. The nozzles 22 create a hydraulic jet directed at the wellbore tubular 10. The nozzles 22 can be shaped to focus the perforating fluid on the wellbore tubular 10. The perforating fluid includes abrasive particles, which may be sand, ceramic, calcium carbonate, soda glass and other mineral and synthetic materials. Among the factors that determine the hole size and depth, and the time it takes to open the holes are the distance between the nozzle 22 and wellbore tubular 10, the type of the perforating fluid and the particles, the flow rate of the perforating fluid, the pressure across the nozzle 22, the backpressure and the design of the nozzle 22.

Adjacent to the perforator is the restrictor 30. The restrictor 30 changes the flow direction from substantially parallel to the wellbore to substantially transverse to the wellbore. The restrictor 30 can have a single restriction element 32 attached to a restrictor housing 34. The restriction element 32 projects radially from the well tool toward an inner surface of the wellbore tubular 10. The restriction element 32 has an outer surface 38 that faces the wellbore tubular 10.

The gap 70 separating the outer surface 38 and the wellbore tubular 10 is sized to facilitate movement of the restrictor 30 through the wellbore tubular 10 while providing the necessary fluid sealing effect during operation. For example, the gap 70 is sufficiently large to reduce the likelihood that the restrictor 30 will impact or get caught on a shoulder, ledge, or other feature on the inner surface of the wellbore tubular 10. At the same time, the gap 70 is sufficiently small to allow materials pumped from the surface to substantially block flow across the gap 70.

For instance, after the perforation is completed, fluids with entrained materials may be pumped through the annulus between the wellbore tubular 10 and the conveyance device 12. The treatment fluid can include mixtures and entrained particles, which may be solids or semi-solids. The particles of the treatment fluid or the perforation fluid fall in the range of 12 mesh to 200 mesh. The mesh of the particles is determined by a standardized sieve series. 12 mesh sieve has 0.0661 inch openings, and 200 mesh sieve has 0.0029 inch openings. Particle size is measured in mesh size ranges within which 90% of the particles fall. The size of the flow space 71 causes these particles to accumulate along the outer surface 38 and at least restrict the treatment fluid flow across the restrictor 30. Herein, at least restricting means limiting the flow by the assistance of the particles in the flow mixture. For example, the particles may reduce or block the available flow space. Thus, the flow can be fully restricted, but the gap 70 still remains. The restrictor 30 diverts a substantial amount of the treatment fluid through the holes 16 formed by the perforator 20. Herein, substantial amount means 90 percent or more of the treatment fluid pumped. Therefore, it is not necessary that the treatment fluid particles completely block fluid pass. In this regards, the isolation provided is, at least initially, not a perfect seal, therefore, a certain amount of leakage will occur.

Figure 2:
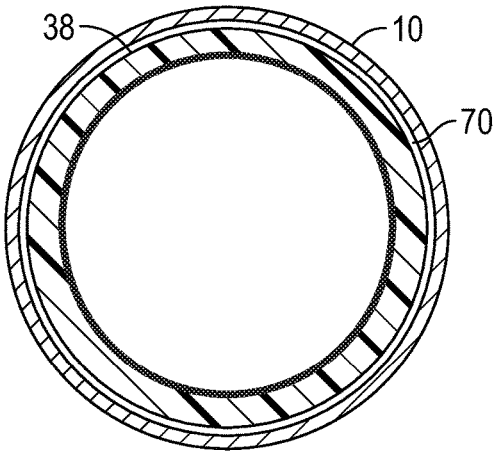
FIG. 2 illustrates an exemplary gap between a restrictor and a wellbore tubular around the restrictor.

FIG. 2 illustrates the gap 70 between the restrictor 30 and the wellbore tubular 10 before treatment fluid particles accumulate around the restrictor 30. The space between the outer surface 38 of the restrictor 30 and the inner surface of the wellbore tubular 10 provides the predetermined gap 70. Here, "predetermined" is used to represent an engineered calculation to have certain characteristics.

The gap 70 provides a functional space, not necessarily a minuscule space. Initially, fluid escapes through the gap 70 so that deployment of the well tool 9 is convenient because swab and surge effects may be reduced. Also, the perforating fluid may escape through the gap. The particles in the treatment fluid may be the only source to restrict the gap 70. Particle size pumped may be changed during the treatment operation. For example, the treatment may start with large particles and end with smaller particles.

Figure 3A:
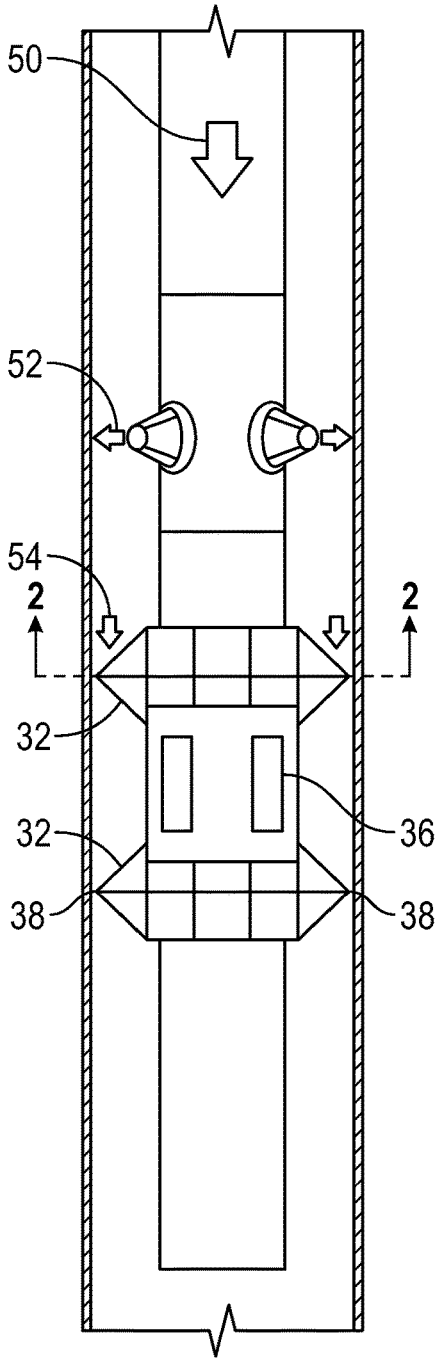
FIG. 3A-B show an exemplary perforator and restrictor with two restriction elements during perforation and well stimulation, respectively.
Figure 3B:
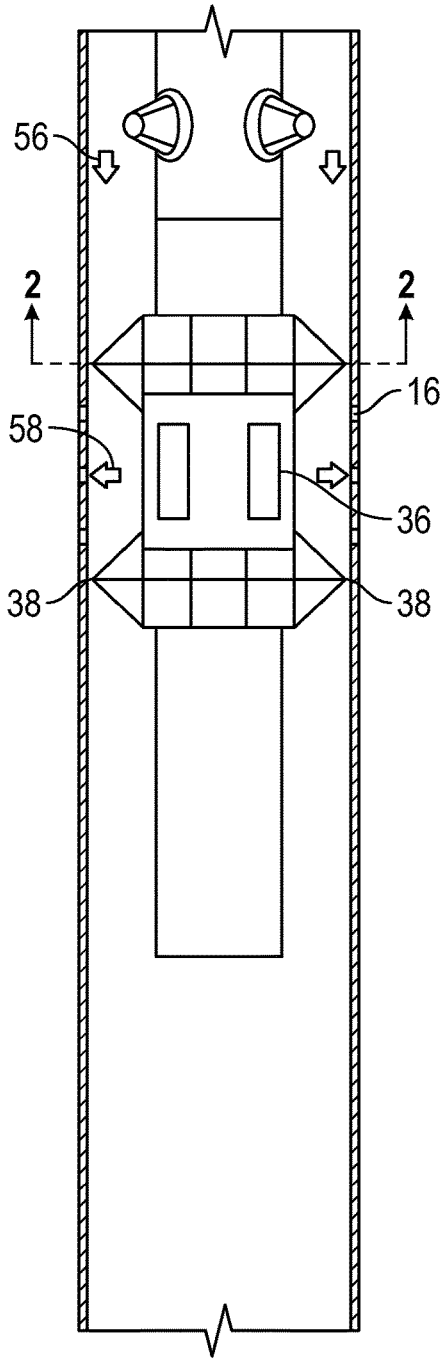

Another non-limiting embodiment of the restrictor 30 utilizing the gap 70 is described in reference to FIG. 3A-B. The restrictor 30 has one or more ports 36 on the restrictor housing 34 that are positioned between two restriction elements 32. This arrangement can be used with wells with pre-existing perforations or other flow paths. The restrictor 30 directs the flow from a longitudinal direction 56 to a transverse direction 58 so that a substantial amount of the treatment fluid finds its way into the formation.

In this configuration during the treatment operation, the perforator 20 does not allow fluid to pass from the annulus into the flow bore of the conveyance device 12. A cross-over sub (not shown) located between the perforator 20 and the restrictor 30 may be used to direct the treatment fluid from the annulus to the restrictor 30. The cross-over sub allows the fluid flowing down the annulus of the conveyance device 12 above the well tool 9 to cross over into the lower flowbore below the perforator 20. In another embodiment, the treatment fluid may be pumped down the flowbore of the conveyance device 10 (and not through the annulus), therefore, not requiring a cross-over sub.

The restriction elements 32 may be a fixed cone, an expandable cone, a ring, a swab cup, an elastomeric body, or a cylindrical compartment. The first restriction element 32 may be different from the second restriction element 32 of the same restrictor 30. The restrictor 30 may have more than two restriction elements 32. The distance between the restriction elements 32 may be equal to, or more or less than the length of the span of set of nozzles 22.

The restriction elements 32 may be made of a degradable material, phenolics, polyvinyl alcohols, polyacrylamide, polyacrylic acids, rare earth elements, glasses (e.g. hollow glass microspheres), carbon, elastic material, or a combination of these materials or above sintered powder compact material. Elastic material herein includes elastomers and means that the degradable diverter can flex. The structure of the degradable material is explained below in detail.

The restrictor 30 may be connected to the conveyance device 12 through any suitable means. The conveyance device 20 may be tubing, coiled tubing, drillpipe, wireline, slickline, electric line or a combination thereof. The conveyance device 12 is fluidly connected to a well treatment system (not shown) including one or more pumps, or other fluid mover (not shown) preferably located at the surface. The well treatment system moves the perforating fluid through the flow bore 26 and through the perforator nozzles 22. The fluid mover also pumps treatment fluid to the well tool 9.

In one method of use, during the operation mode, the conveyance device 12 is used to deploy the well tool 9 at a specific target depth along the wellbore tubular 10. The well treatment system supplies the perforating fluid through the flow bore of the conveyance device 12. The perforating fluid exists through the nozzles 22 and performs the jetting job. After holes 16 are created on the wellbore tubular 10, the well treatment system supplies the treatment fluid through the annulus. The subterranean formation may be fractured with the treatment fluid. After fracturing is completed, the conveyance device 12 pulls the well tool 9 up the wellbore to repeat the process at another depth.

In another mode of operation, the conveyance device 12 may push the well tool 9 in the downhole direction to treat a lower subterranean zone. In that mode of operation, the restrictor 30 may be in the uphole direction of the perforator 20. Also, in another mode of operation where two restriction elements 32 are used, as shown in FIG. 3A-B, after the perforation is completed, the well treatment system may provide the treatment fluid through the annulus and into the restrictor 30 via a cross-over sub. The treatment fluid exits through the ports 36 of the restrictor 30 and through the holes 16 and flows into the subterranean formation.

Figure 4:
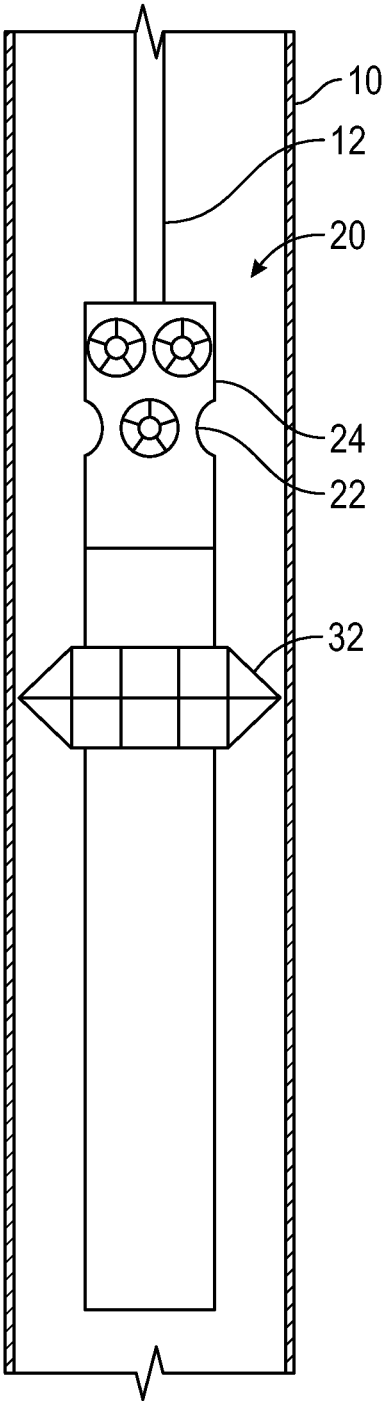
FIG. 4 illustrates an exemplary perforator with an explosive shape charge and a restrictor.

It should be appreciated that the well tool 9 of the present disclosure is subject to various embodiments. In one non-limiting embodiment of the present disclosure is shown in FIG. 4. The perforator 20 may have explosive shape charges that may be activated by a detonator. Other perforators 20 may use electrical, chemical or mechanical means to create holes in the wellbore tubular 10. In this embodiment, the annulus is used to flow the treatment fluid.

In another embodiment and method, a polymer fluid supplied by the fluid mover (not shown) may plug the perforator nozzles 22. The polymer fluid may be provided through the flow bore of the conveyance device 12. After the polymer fluid flows through the well tool 9, the treatment fluid can be supplied through the flow bore.

Optionally, the gap 70 may only to be restricted by particles in the treatment fluid. Alternatively, particles in the perforating fluid may also restrict the gap 70. The perforating fluid and the treatment fluid may have the same type or size of particles at a different mass fraction. Or, the perforating fluid and the treatment fluid may have different sized and shaped particles.

In another embodiment and method, the treatment fluid or the perforating fluid can be directed to the restrictor 30 or the perforator 20, selectively via valve actuators well know in the art. The restrictor 30 or the perforator 20 may be activated by mechanical actuators, J-slot mechanisms, hydrostatic fluid pressure or hydraulic control lines and seated ball valves, other ball valves, check valves, choke valves, butterfly valves, poppet valves, shear mechanisms, servo valves, other electronic controls etc.

The well tool according to the present disclosure can be used for various well treatment operations. The well treatment operation includes well cleaning, hydraulic fracturing, acidizing, cementing, plugging, pin point tracer injection or other well stimulation or intervention operations. Stimulation operation is an operation that changes the characteristic of the formation or the fluid inside the formation. The use of well tools according to the present disclosure is explained above in connection with, but not limited to, hydraulic fracturing operations.

Figure 5A:
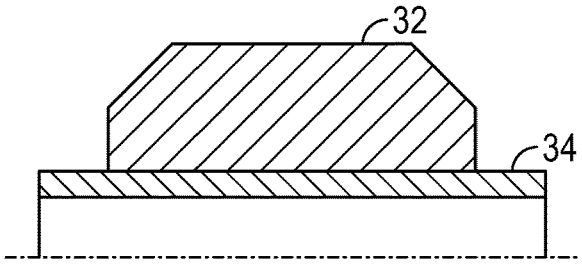
FIGS. 5A-D show axial cross-sections of exemplary restriction elements.

In one non-limiting embodiment, the restriction element 32 may have a fixed dimension. FIG. 5A shows an axial cross-section of the restriction element 32 that continuously and circumferentially surrounds the restrictor housing 34. The restriction element 32 may be formed as a collar and have a chamfered rectangular axial cross-section. The restriction element 32 may be formed as a single body or as segmented assembly.

Figure 5B:
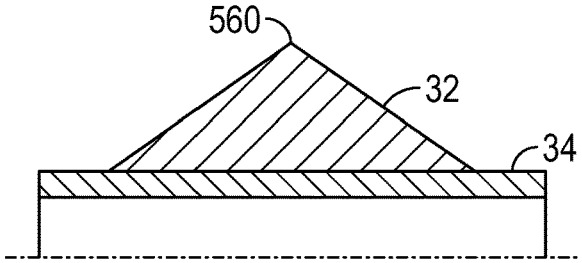
Figure 5C:
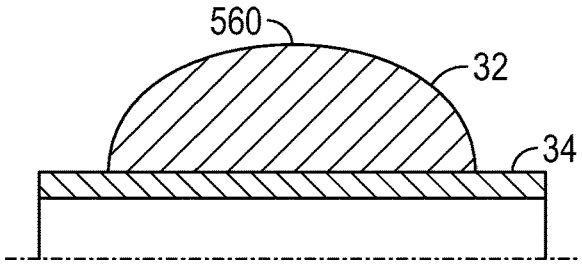
Figure 5D:
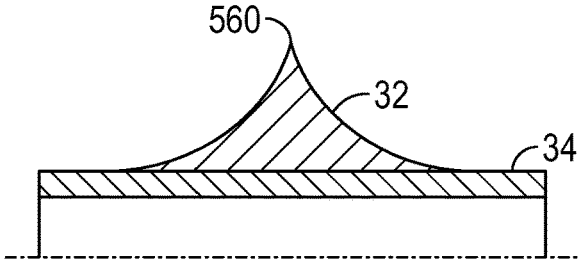

FIGS. 5B-D show other shapes and configurations of the restriction element 32. FIG. 5B shows the restriction element 32 that has a triangular cross-section. FIG. 5C shows the restriction element 32 with a semi-circular cross section. FIG. 5D shows the cross section of the restriction element 32 defined by two concave arcs and an outer surface of the restrictor housing 34. Other polygons, concave or convex shapes, and shapes defined by an arc, or a combination of these as axial cross sections can be used for the design of the restriction element 32.

In other embodiments, the restriction element 32 may have an adjustable outer diameter, e.g., the restriction element 32 may expand and retract by hydrostatic or hydraulic pressure, or mechanical, acoustic, electrical or electromagnetic means. FIG. 6A-D illustrate the restriction elements 32 that have adjustable outer diameters. Specifically, the diameters of the FIG. 6A-D restriction elements 32 can be increased to reduce the gap 70 between the restrictor 30 and the wellbore tubular 10. For simplicity, a hydraulic actuation will be used in the following discussion.

Figure 6A:
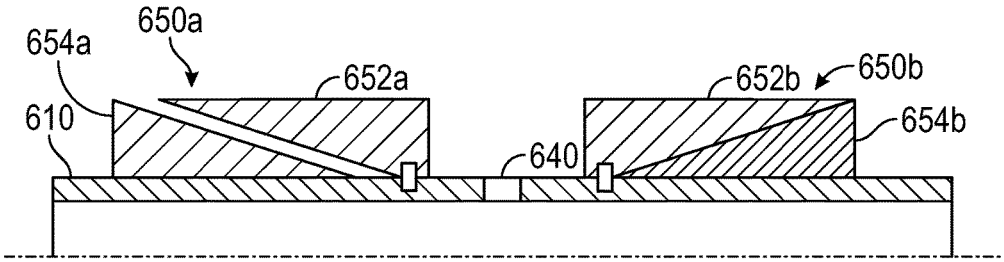
FIGS. 6A-D show axial cross-sections of exemplary restriction elements with mating elements.

The FIG. 6A embodiment includes a restrictor 30 that has two cooperating mating elements (mates) 652*a,b* and 654*a,b* that are initially fixed to one another with a locking device (not shown). The treatment fluid exits from the port 640, applies hydraulic pressure on the mates 652*a,b*. Applied pressure shears the locking mechanism and moves the mates 652*a,b* towards mates 654*a,b* respectively. The mates 652*a,b* move radially outward as the mates 652*a,b* travel along the inclined surface of the mates 654*a,b*. The mates 652*a,b* may have slots or elastic or plastic properties to allow them shift radially outward. Before activation, the mates may have a clearance in between as shown by 652*a* and 654*a*, or may be in full contact on their respective inclined surfaces as shown by 652*b* and 654*b* as depicted in FIG. 6A.

Figure 6B:
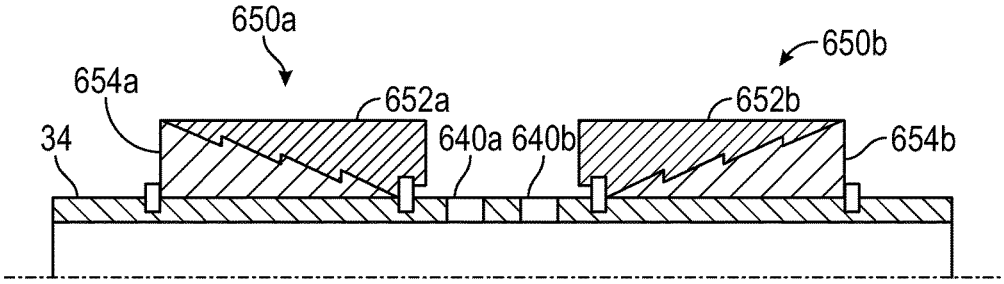
Figure 6C:
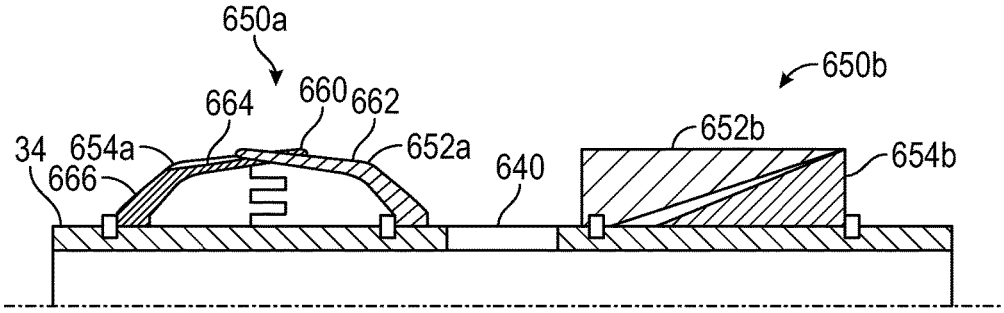
Figure 6D:
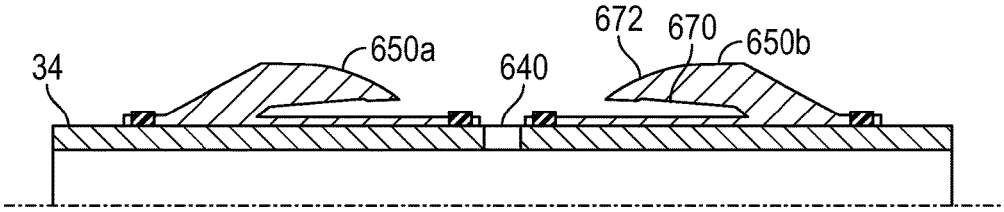

FIG. 6B shows the mates 652*a,b* as a ratchet mechanism that allows movement in one direction but prevents movement in the opposite direction. The movement increases the outer diameter of the restrictor 30. FIG. 6C shows the mates 652*a* and 654*a* as collet fingers that are adjustable to extend radially outward by a lever 664. The lever 664 may be attached to the mate 654*a* or the restrictor housing 34. FIG. 6D shows the restrictor 30 with two elements 650*a,b* as swap cups. The treatment fluid can exit from the port 640 and pressurize the volume 670. The treatment fluid can extend the lips 672 radially outward and increase the outer diameter of the restrictor 30. A combination of above elements 650*a,b* in FIGS. 5A-D and 6A-D may be used in the restrictor 30.

Also, the restrictor 30 may be used to locate perforations or other flow paths 16 formed during previous operations. For example, to locate flow paths formed during a previous separate trip into the wellbore, the restrictor 30 can have two restriction elements 32 with a sensor estimating the pressure of the volume of fluid trapped between two restriction elements 32.

Alternatively, the restriction element 32 may be "degradable." Herein, "degradable" means disintegrable, corrodible, decomposable, soluble, or at least partially formed of a material that can undergo an irreversible change in its structure. Examples of suitable materials and their methods of manufacture are given in United States Patent Publications No. 2013/0025849 (Richard and Doane) and 2014/0208842 (Miller et al.), and U.S. Pat. No. 8,783,365 (McCoy and Solfronk), which Patent Publications and Patents are hereby incorporated by reference in their entirety. A structural degradation may be a change in phase, dimension or shape, density, material composition, volume, mass, etc. The degradation may also be a change in a material property; e.g., rigidity, porosity, permeability, etc. Also, the degradation occurs over an engineered time interval; i.e., a predetermined time interval that is not incidental. Illustrative time intervals include minutes (e.g., 5 to 55 minutes), hours (1 to 23 hours), or days (2 to 3 or more days).

The restriction element 32 can be high-strength and lightweight, and have fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications.

Suitable core materials include electrochemically active metals having a standard oxidation potential greater than or equal to that of Zn, including as Mg, Al, Mn or Zn or alloys or combinations thereof. For example, tertiary Mg—Al—X alloys may include, by weight, up to about 85% Mg, up to about 15% Al and up to about 5% X, where X is another material. In one embodiment, the material has a substantially uniform average thickness between dispersed particles of about 50 nanometers (nm) to about 5000 nm. In one embodiment, the coating layers are formed from Al, Ni, W or Al2O3, or combinations thereof. In one embodiment, the coating is a multi-layer coating, for example, comprising a first Al layer, a Al2O3 layer and a second Al layer. In some embodiments, the coating may have a thickness of about 25 nm to about 2500 nm. In addition, surface irregularities to increase a surface area of the restriction element 32, such as grooves, corrugations, depressions, etc. may be used.

As noted above, the degradation is initiated by exposing the degradable material to a stimulus. In embodiments, the restriction element 32 degrades in response to exposure to a fluid. Illustrative fluids include engineered fluids (e.g., frac fluid, acidizing fluid, acid, brine, water, drilling mud, etc.) and naturally occurring fluids (e.g., hydrocarbon oil, produced water, etc.). The fluid used for stimulus may be one or more liquids, one or more gases, or mixtures thereof. In other embodiments, the stimulus may be thermal energy from surrounding formation. Thus, the stimulus may be engineered and/or naturally occurring in the well or wellbore tubular 10 and formation.

Figure 7:
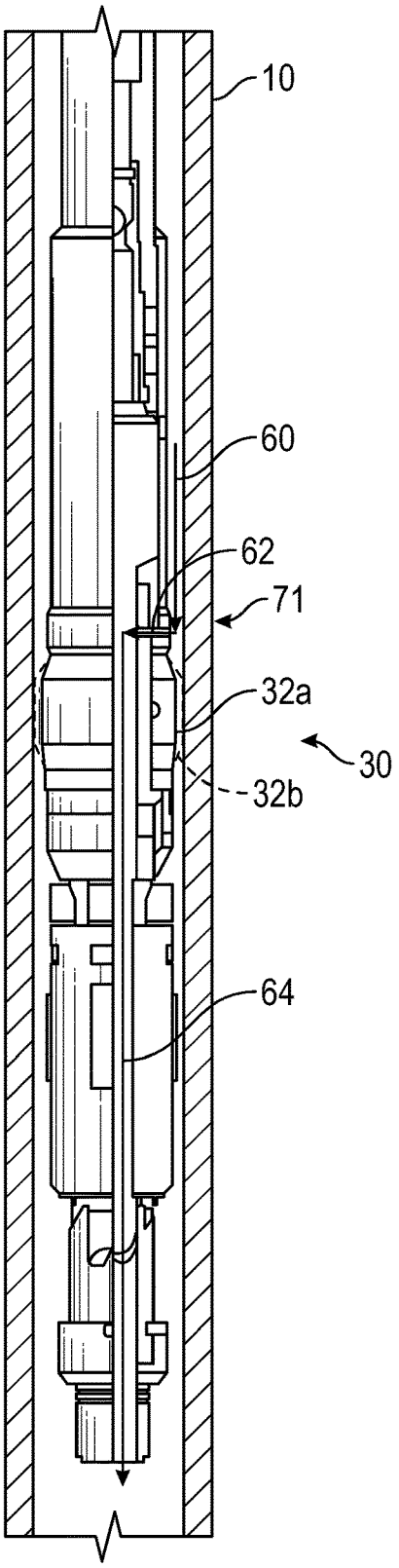
FIG. 7 shows an exemplary flow space with an opening.

In another embodiment and method, as shown in FIG. 7, the flow space 71 includes an opening 62 and an interior channel 64, and is located on the uphole side of the restrictor 30. The restrictor 30 may be a packer or may include a restriction element 32*a* . The work string is deployed at the desired depth and the restriction element 32*a* is expanded to form the restriction element 32*b* . In one method, the outer surface of the restrictor 30 may seal the wellbore tubular 10. The perforating fluid is pumped through the flowbore and out through the nozzles 22 (FIG. 1). After the perforation is completed, the treatment fluid is pumped through the annulus along direction 60. The opening 62 of the flow space 71 may be located on the restrictor housing 34, or at another location along the conveyance device 12. The flow space 71 may connect the annulus to the flowbore. The treatment fluid flows into the opening 62, and the interior channel 64 allows the fluid to bypass across the restriction element 32. The interior channel 64 is radially inside the restrictor 30. Alternatively, the flow space 71 and the perforator 20 may be located on the downhole side of the restrictor 30. Or, the restrictor 30 may have two restriction elements 32.

The foregoing description is directed to particular embodiments of the present disclosure for the purpose of illustration and explanation. It will be apparent, however, to one skilled in the art that many modifications and changes to the embodiment set forth above or embodiments of different forms are possible without departing from the scope of the disclosure. It is intended that the following claims be interpreted to embrace all such modifications and changes.

We claim:

1. An apparatus for performing a downhole operation in a wellbore tubular, comprising:
- a well treatment system that supplies a treatment fluid;
- a conveyance device; and
- a well tool conveyed by the conveyance device, the well tool including:
  - a perforator configured to form at least one hole in the wellbore tubular; and
  - a restrictor projecting from an outer surface of the well tool and adjacent to the perforator, wherein a gap always separates the restrictor and the wellbore tubular while the well treatment system supplies a treatment fluid, the restrictor at least restricting fluid flow between the restrictor and the wellbore tubular, and the restrictor diverting a substantial amount of the treatment fluid through the at least one hole formed by the perforator; and
- wherein the restrictor comprises at least two flow restriction elements and at least one port between the flow restriction elements and wherein the perforator is not positioned between the at least two flow restriction elements.

2. The apparatus of claim 1, wherein the perforator comprises at least one of: (i) explosive shape charges, (ii) nozzles directing an abrasive jet against the wellbore tubular, (iii) nozzles directing a water jet against the wellbore tubular, (iv) bullet gun, and (v) a mechanical cutter.

3. The apparatus of claim 1, wherein the well tool comprises an at least one port directing the treatment fluid to the at least one hole, wherein the restrictor is between the perforator and the at least one port.

4. The apparatus of claim 1, wherein the restrictor comprises a flow restriction element, wherein the flow restriction element has a concave outer surface to accumulate particles of a treatment fluid and minimize fluid force acting on the gap.

5. The apparatus of claim 1, wherein the restrictor comprises at least one of (i) ceramics, (ii) phenolics, (iii) metals, (iv) polyvinyl alcohols, (v) polyacrylamide, (vi) polyacrylic acids, (vii) rare earth elements, (viii) glasses, (ix) carbon, and (x) degradable materials.

6. The apparatus of claim 1, wherein the restrictor has an adjustable outer diameter, the outer diameter expanding from a first diameter during run-in to a second larger diameter during operation.

7. The apparatus of claim 1, and wherein the treatment fluid comprises at least one of: (i) hydraulic fracturing fluid, (ii) acidizing fluid, (iii) tracer, (iv) injection fluid, (v) well cleaning fluid, and (vi) other stimulation fluids.

8. The apparatus of claim 1, wherein the gap is sized to accumulate particles in the range of 12 mesh to 200 mesh.

9. An apparatus for performing a downhole operation in a wellbore tubular, comprising:
- a well treatment system that supplies a treatment fluid;
- a conveyance device; and
- a well tool conveyed by the conveyance device, the well tool including:
  - a perforator configured to form at least one hole in the wellbore tubular;
  - a restrictor projecting from an outer surface of the well tool and adjacent to the perforator, the restrictor restricting fluid flow through an annulus between the restrictor and the wellbore tubular, and wherein the restrictor has an adjustable outer diameter and is configured to contact the inner surface of the wellbore tubular; and a flow space that always providing fluid communication between a location uphole of the restrictor and a location downhole of the restrictor, wherein the flow space is sized to allow for the formation of a flow restriction by particles in the treatment fluid, and wherein the flow space includes an opening to receive the treatment fluid from the annulus and carry the treatment fluid across the restrictor to a downhole location;

wherein the well tool diverts a substantial amount of the treatment fluid through the at least one hole formed by the perforator.

10. A method of performing a downhole operation in a wellbore tubular, comprising:

deploying a perforator and a restrictor at a target depth using a conveyance device, wherein the restrictor is disposed at least partially in an annulus between the conveyance device and the wellbore tubular, wherein a gap separates the restrictor and the wellbore tubular;

activating the perforator;

opening an at least one hole in the wellbore tubular;

pumping a treatment fluid into the wellbore tubular only after activating the perforator and opening the at least one hole; and restricting flow through the gap to divert a substantial amount of the treatment fluid into the opened hole in the wellbore tubular using the restrictor, wherein the gap is sized to allow for the formation of a flow restriction in the gap by particles in the treatment fluid.

11. The method of claim 10, further comprising repeating the steps of claim 10 at a plurality of target depths.

12. The method of claim 10, further comprising:

pumping a testing fluid through the wellbore tubular and through at least one port adjacent to the restrictor;

locating at least one flow path in the wellbore tubular by estimating a pressure adjacent to the restrictor; and positioning the perforator with reference to the located at least one flow path.

13. The method of claim 10, wherein the gap is sized to form a flow restriction in the gap by using only particles in the treatment fluid.

14. The method of claim 10, further comprising pumping a polymer fluid into a flow bore of the conveyance device and plugging a plurality of nozzles of the perforator with the polymer fluid.

15. The method of claim 10, wherein the gap is only restricted by the treatment fluid flowing therethrough, wherein a geometry of the gap is substantially unchanged, and wherein the flow restriction element has a concave outer surface engineered to accumulate particles in the treatment fluid.

16. The method of claim 10, further comprising treating a subterranean formation with the treatment fluid, and the treatment includes at least one of: (i) hydraulic fracturing, (ii) acidizing, (iii) tracer logging, (iv) injection, (v) well cleaning, and (vi) stimulation operation.

* * * * *